US009243348B2

(12) United States Patent
Stündl et al.

(10) Patent No.: US 9,243,348 B2
(45) Date of Patent: Jan. 26, 2016

(54) APPARATUS FOR MELT-SPINNING, DRAWING AND WINDING MULTIPLE SYNTHETIC THREADS

(71) Applicant: OERLIKON TEXTILE GMBH & CO. KG, Remscheid (DE)
(72) Inventors: Mathias Stündl, Wedel (DE); Marco Kaulitzki, Nortorf (DE); Claus Matthies, Ehndorf (DE); Ludger Legge, Ehndorf (DE); Freddy Van Tricht, Neumünster (DE)
(73) Assignee: OERLIKON TEXTILE GMBH & CO., KG, Remscheid (DE)

( * ) Notice: Subject to any disclaimer, the term of this patent is extended or adjusted under 35 U.S.C. 154(b) by 567 days.

(21) Appl. No.: 13/663,638

(22) Filed: Oct. 30, 2012

(65) Prior Publication Data

US 2013/0049253 A1 Feb. 28, 2013

Related U.S. Application Data

(63) Continuation-in-part of application No. PCT/EP2011/057002, filed on May 3, 2011.

(30) Foreign Application Priority Data

May 7, 2010 (DE) ..... 10 2010 019 696

(51) Int. Cl.

| | |
|---|---|
| ***D01D 5/16*** | (2006.01) |
| ***D01D 7/00*** | (2006.01) |
| ***D01D 10/04*** | (2006.01) |
| ***D01D 10/02*** | (2006.01) |
| ***D01D 5/22*** | (2006.01) |
| ***D02J 1/22*** | (2006.01) |
| ***D01D 13/00*** | (2006.01) |

(52) U.S. Cl.

CPC .. *D01D 7/00* (2013.01); *D01D 5/16* (2013.01); *D01D 5/22* (2013.01); *D01D 10/02* (2013.01);

(Continued)

(58) Field of Classification Search

CPC ..... D01D 5/16; D01D 5/22; D01D 7/00; D01D 10/02; D01D 10/0463; D02J 1/22; D02J 1/225

See application file for complete search history.

(56) References Cited

U.S. PATENT DOCUMENTS 4,042,662 A * 8/1977 Corbin et al. ..... 264/210.3
4,522,774 A * 6/1985 Donnelly et al. ..... 264/168

(Continued)

FOREIGN PATENT DOCUMENTS

DE 102 36 826 A1 4/2004
DE 10 2007 003 949 8/2007

(Continued)

OTHER PUBLICATIONS

PCT/EP2011/057002 International Preliminary Report on Patentability dated Nov. 13, 2012 (6 pages).

*Primary Examiner* — Yogendra Gupta
*Assistant Examiner* — Joseph Leyson
(74) *Attorney, Agent, or Firm* — Brinks Hofer Gilson & Lione; G. Peter Nichols

(57) ABSTRACT

The invention relates to a process for melt-spinning, drawing and winding multiple synthetic threads and to an apparatus for performing the process. The synthetic threads are spun concurrently side by side through extrusion of fine filamentous strands, cooled down and hauled off to be then collectively drawn as a sheet of threads and wound up on bobbins. To obtain ideally identical physical properties in the collective treatment of the threads, the threads are hauled off independently of each other by separate individual godets after extrusion and before collective drawing. This makes it possible to realize for each thread the same conditions during extrusion, cooling and hauling off. The apparatus includes multiple individual godets arranged side by side, which are arranged upstream of the drawing facility and are each associated with one of the threads. To pull off the threads, the individual godets are configured to be individually driveable.

6 Claims, 4 Drawing Sheets

(52) U.S. Cl.
CPC ..... *D01D 10/0463* (2013.01); *D01D 13/00* (2013.01); *D02J 1/22* (2013.01); *D02J 1/225* (2013.01)

(56) References Cited

U.S. PATENT DOCUMENTS

| | | | | |
|---|---|---|---|---|
| 5,076,773 | A | 12/1991 | Bert | |
| 5,928,579 | A | 7/1999 | Spahlinger et al. | |
| 6,447,703 | B1 | 9/2002 | Waddington et al. | |
| 7,241,123 | B2 * | 7/2007 | Kirchhoff et al. | 425/66 |
| 7,585,445 | B2 * | 9/2009 | Tiemeier et al. | 264/210.7 |

FOREIGN PATENT DOCUMENTS

| | | |
|---|---|---|
| DE | 10 2009 021 131 | 12/2009 |
| EP | 0 285 736 | 10/1988 |
| EP | 0 845 550 | 3/2004 |

* cited by examiner

APPARATUS FOR MELT-SPINNING, DRAWING AND WINDING MULTIPLE SYNTHETIC THREADS

This application is a continuation-in-part of and claims the benefit of priority from PCT application PCT/EP2011/057002 filed May 3, 2011 and German Patent Application DE 10 2010 019 696.7 filed May 7, 2010, the disclosure of each is hereby incorporated by reference in its entirety.

The present invention relates to a process for melt-spinning, drawing and winding multiple synthetic threads and to an apparatus for carrying out the process.

BACKGROUND

In the production of synthetic threads in a melt-spinning process, it is usual that in a spinning position side by side, a plurality of threads are extruded, cooled, drawn and wound in parallel to bobbins. After extrusion, the threads are led as a sheet of strands and collectively drawn by godets and collectively wound in multiple winding stations on bobbins. In order to be able to simultaneously pull off the plurality of threads by a godet from the spinnerets, it is also usual to guide the threads in a first transition section to a smaller distance from each other. During the extrusion and the cooling stages, the spinnerets are kept spaced with respect to each other so that the threads are guided within a vertical spinning section at a spinning distance near each other. The collective guidance of the threads on the godets requires a smaller distance godets so that the transition section between the spinning apparatus and the drawing apparatus is used for merging the threads. For this purpose, it is necessary to deflect in particular the threads in the outer regions of the sheet of strands. In addition, there thus result different pull-off ratios of the threads during the extrusion of the thread strands at the spinnerets.

Such a method and such an apparatus are known, for example, from EP 0 845 550 A1. In this method and apparatus, after drawing and before winding up, the threads are guided through individually driven delivery apparatuses in order to be able to compensate for the differences in tension arising from the different deflection of individual threads before winding up the threads. It is true that a homogenization of differences in tension caused by multiple deflections in the threads of the sheet of strands can be achieved. However, the different thread guiding paths occurring already before and during the drawing remain here ignored and directly affect the individual threads during the drawing of the threads.

Such disadvantages in the production of multiple synthetic threads parallel side by side can be entirely avoided only if every single thread is separately and independently pulled off, drawn and wound to bobbins. Such a method and such an apparatus are known, for example, from DE 102 36 826 A1. In this method and apparatus, a separate drawing apparatus is provided for each thread, which interacts with a winding apparatus. This permits substantially straight thread runs between the spinning apparatus and the drawing apparatus. However, such methods and apparatuses require much more space, because all devices for pulling-off, drawing, treatment and winding of threads must be present in multiple numbers. To this extent, these methods and apparatuses are preferably used for the production of composite fibers, in which each of the generated partial threads must have the same properties.

New developments, such as for example those known from DE 10 2009 021 131 A1, are based on an arrangement in which the drawing device is arranged laterally adjacent to the spinning device, wherein between the spinneret and the drawing device deflecting rollers are arranged for each thread. This allows larger deflections in the transition region between the drawing device and the spinning device to be avoided. However, the free thread route between the drawing device and the spinnerets is formed differently in length for each thread. In that regard, differences can also be expected in this method.

SUMMARY

The technical task of the invention is to propose a method for melt-spinning, drawing and winding multiple synthetic threads and to provide an apparatus for performing the method of the generic type, in which the threads can be produced with as high homogeneity as possible.

This technical task is inventively achieved by a method such that after extrusion and before the collective drawing the threads can be pulled off each other independently by separate individual godets.

In the apparatus, this technical task is solved by providing a plurality of juxtaposed individual godets arranged upstream of the drawing device, wherein each individual godet is associated with one of the threads and are formed to be individually drivable for the withdrawal of the respective threads.

Advantageous developments of the invention are defined by the features and combinations of features of the respective claims.

The invention is based on the insight that during the extrusion, cooling and drawing, the processes relevant for the determination of the physical properties of the threads occur on the basis of solidifying the amorphous molecular structure and the crystallization. The molecular structure formed in the threads during the drawing thus represents the essential foundation for achieving the desired effects during further treatment. According to the present invention, each thread is associated with an individual godet that determines the respective pull-off of the thread from the spinneret. As a result, each of the threads can be pulled and fed to collective drawing with essentially identical properties, regardless of the number of threads produced per spinning position.

For this purpose, it is preferred that the threads are pulled off at the individual godets in a straight thread run with equal speeds. This allows high and uniform throughput of the spinnerets to be achieved.

For the production of threads with larger titers, it has been found that it is effective if the threads are guided on the periphery of each individual godet in multiple wraps. This results in higher extraction forces at each of the individual threads.

In order for the subsequent treatments of the thread to be performed for all the threads collectively, it is further provided that after being pulled off, the threads are brought together to form a sheet of strands, and that the sheet of strands are drawn by being guided over several godets that are arranged one after the other. Thus a collective drawing of the threads is possible.

A safe guiding of the threads is required in order to be able to maintain the lowest possible spacing between the individual threads of the sheet of strands. This is achieved by driving the first drawing godet at a peripheral speed that is equal to or greater than the pull-off speed of the individual godet. Preferably a weak drawing is set between the pull-off godets and the drawing godet. Depending on the type of thread and the process, the threads can be tempered directly at the individual godets.

The inventive method and the apparatus of the invention are particularly suitable for such threads where after the melting-spinning process they are fed directly to a final processing. Optionally, the threads can be crimped in parallel after the drawing and before the winding the threads. Such crimped threads can be advantageously used as carpet threads.

For realizing a straight thread path during the pull-off of the threads, the inventive apparatus is preferably designed such that the individual godets are associated with the spinnerets at a distance and centered. This allows each thread to be pulled off with high uniformity and, in particular, the filament strands that form the thread from the spinneret have high uniformity.

To generate higher pull-off forces, overtravel rollers are associated with a respective individual godet to guide the relevant threads. Thus, each of the threads can be led at the individual godet with a multiple wrap.

Depending on the method and the type of thread, a first tempering of the thread is already made possible in that each of the individual godets comprise a heatable godet shell. Especially with the multiple wraps, preparatory drawing warming can thus be supplied into the thread.

In order to obtain a low profile of the overall apparatus, on the one hand, and small displacements, on the other hand, according to a particularly advantageous embodiment of the invented apparatus, a first drawing godet of the drawing device is arranged laterally adjacent with or downstream from the series of the individual godets. The inlet of the first drawing godet is associated with the outlet of a multiple thread guide. Thus, the threads can be fed to the drawing godet together as one sheet of strands with a narrow treatment distance from each other.

The inventive apparatus may also include a crimping device between the drawing device and the winding device. The crimping device has a plurality of texturing means for collectively crimping the threads. This advantageously produces carpet threads that can be directly introduced to a finishing process.

The inventive method and the inventive apparatus are explained below in more detail with reference to some embodiments shown in the accompanying figures.

DETAILED DESCRIPTION

Figure 1:
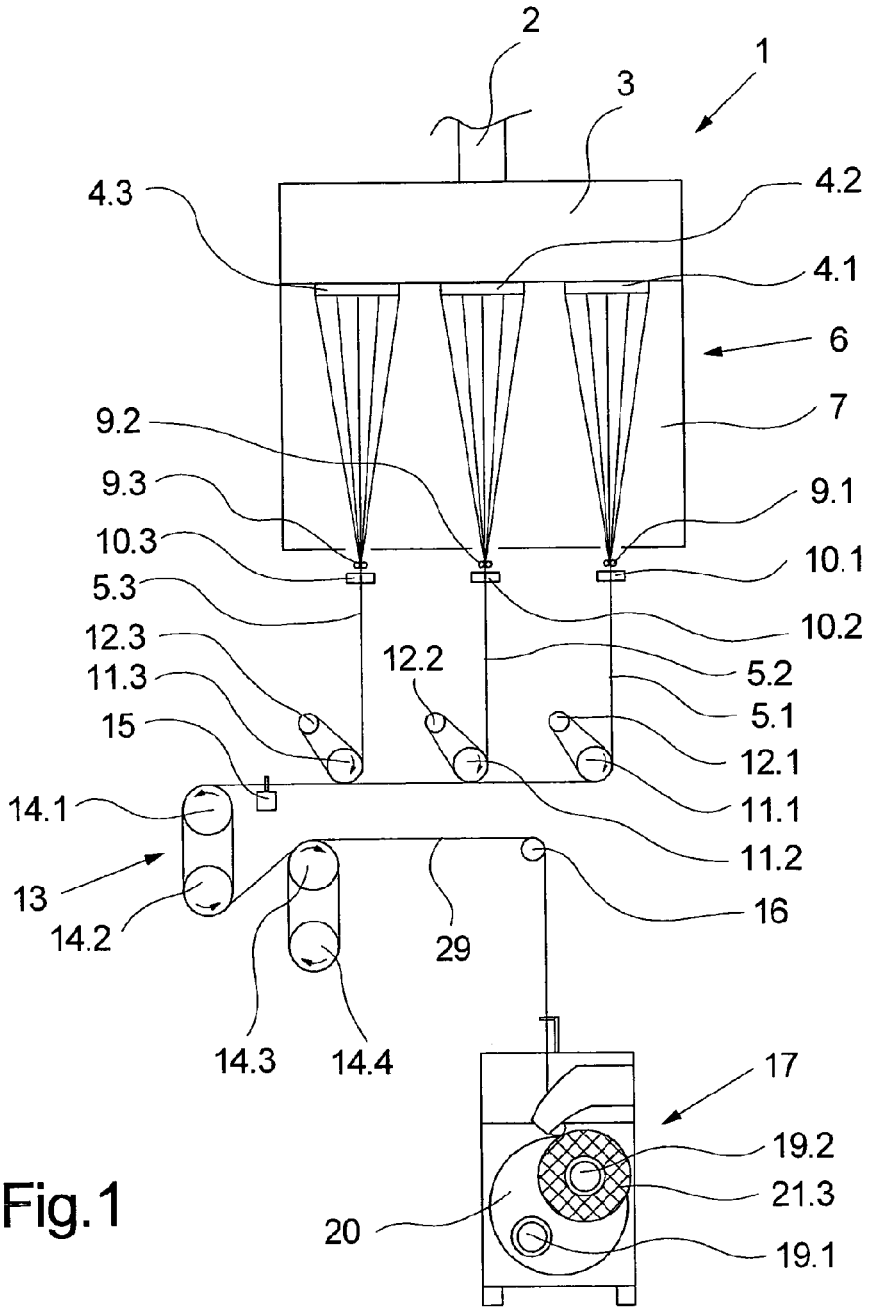
FIG. 1 schematically shows a front view of a first embodiment of the inventive apparatus for carrying out the method.
Figure 2:
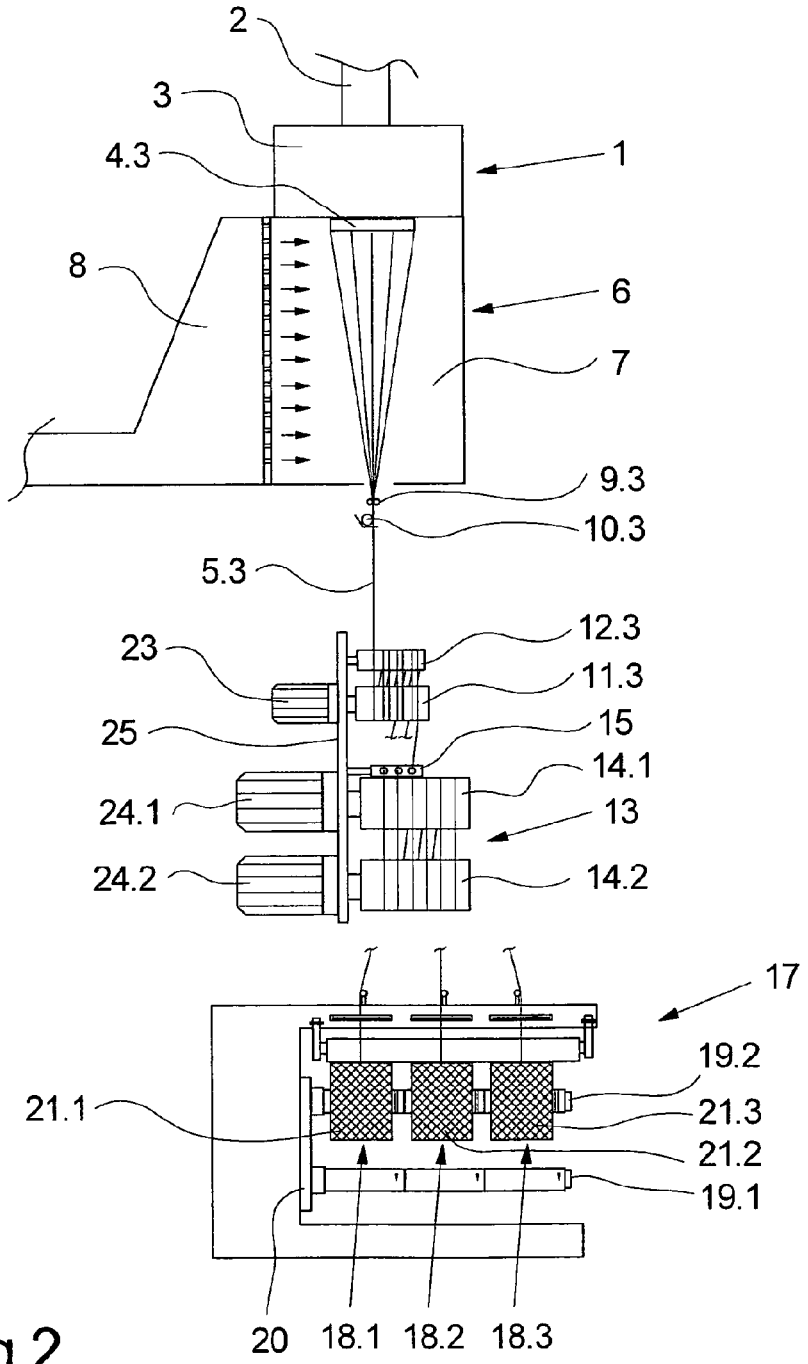
FIG. 2 is a schematic side view of the embodiment of FIG. 1.

FIGS. 1 and 2 schematically show in several views a first embodiment of the invention apparatus for carrying out the inventive method. FIG. 1 represents the exemplary embodiment schematically in a front view, and FIG. 2 is a schematic side view. Unless an explicit reference to one of the figures is made, the following description applies to both figures.

The embodiment shown in FIGS. 1 and 2 has a spinning unit 1 with a total of three adjacent spinnerets 4.1, 4.2, and 4.3. The number of spinnerets in the spinning unit 1 is just by way of example, and can also be significantly higher per spinning position than three threads. The spinnerets 4.1, 4.2, and 4.3 are held at the bottom of a heated spinning beam 3. The spinning beam 3 contains further melt leading parts, not shown here, to feed the thermoplastic melt of a melt source that is supplied through an inlet 2 to the 5 spinnerets 4.1 to 4.3. In that regard, at least one or several spinning pumps and distribution lines are disposed in the spinning beam 3. The spinnerets 4.1 to 4.3 comprise at their lower sides a plurality of nozzle openings, from which a plurality of strand-like threads is extruded.

Below the spinning beam 3 is arranged a cooling device 6 that extends with a cooling shaft 7 directly below the spinnerets 4.1 to 4.3. The cooling device 6 in this embodiment is designed as cross-flow quenching, in which a cooling air flow is produced by means of a laterally disposed puffer chamber 8 and is directed to the filament strands of the threads 5.1, 5.2, and 5.3.

To merge the plurality of threads generated per spinneret 4.1 to 4.3 to a respective thread, a collecting thread guide 9.1, 9.2 and 9.3 as well as a preparation device 10.1, 10.2 and 10.3 are arranged in each case at a distance underneath the spinnerets 4.1, 4.2, and 4.3. The collecting thread guides 9.1, 9.2, and 9.3 are each held in the middle of the spinnerets 4.1, 4.2, and 4.3. Thus, the collecting thread guide 9.1 is held in the middle of spinneret 4.1.

At this point, it should be specifically noted that the preparation devices 10.1, 10.2, and 10.3 as well as the collecting thread guides 9.1, 9.2, and 9.3 can also be advantageously combined so that the merging of the filament strands and the preparation of the filament strands is carried out, for example, by a pin oiler.

In the further course of the thread, each of the spinnerets 4.1, 4.2, and 4.3 is associated with one of several individual godets 11.1, 11.2, and 11.3, which in this exemplary embodiment are each combined with an overtravel roller 12.1, 12.2, and 12.3. The individual godets 11.1, 11.2, and 11.3 are spaced essentially centrally to the upstream spinnerets 4.1, 4.2, and 4.3. Thus, the threads 5.1, 5.2, and 5.3 can be pulled-off from the spinnerets 4.1, 4.2 and 4.3 respectively vertically in a straight thread run through the individual godets 11.1, 11.2, and 11.3. Thus the individual godet 11.1 is associated with the spinneret 4.1, which extrudes the filament strands for the thread 5.1.

As is apparent from FIG. 2, the individual godets 11.1 to 11.3 and the overtravel rollers 12.1 to 12.3 are supported on a machine frame 25 in a protruding design, wherein each individual godet 11.1 to 11.3 is associated with a drive 23. The drives 23 (in FIG. 2 only one of the drives is shown) independently drive the individual godets 11.1, 11.2, and 11.3. The drives 23 can be controlled both by individual control units and by a common control device.

As is apparent from the illustration in FIG. 1, the individual godets 11.1 to 11.3 are arranged in a row next to each other. In the further course of the threads, a first drawing godet 14.1 of a drawing device 13 is arranged laterally adjacent to or downstream from the godet 11.3. Between the drawing godet 14.1 and the individual godet 11.3 is arranged a multiple thread guide 15, which merges the threads running from the individual godets 11.1 to 11.3 into a sheet of strands 29. Within the sheet of strands 29, the threads 5.1 to 5.3 have an essentially short treatment distance from each other.

The drawing device 13 comprises multiple drawing godets 14.1 to 14.4 for collective drawing of the threads 5.1 to 5.3, wherein each of two godets 14.1 and 14.2 and 14.3 and 14.4 constitute a godet duo, on which the threads are guided in multiple wrap. The drawing godets 14.3 and 14.4 are driven at a higher peripheral speed compared to the godets 14.1 and 14.2 so that the threads are drawn between the godets 14.2 and 14.3. For this purpose, each godet 14.1 to 14.4 is associated with a separate drive. FIG. 2 only shows drives 24.1 and 24.2 of the first two godets 14.1 and 14.2. The drawing godets 14.1 to 14.4 are preferably equipped with heated godet shells.

Underneath the drawing device 13 is arranged a winding device 17 that has a plurality of winding stations 18.1, 18.2 and 18.3. In each of the winding stations 18.1, 18.2 and 18.3, the threads 5.1, 5.2, and 5.3 guided as a sheet of strands are wound, side by side in parallel, to bobbins 21.1, 21.2, and 21.3. For this purpose, the winding device 17 has two winding spindles 19.1 and 19.2, where in turns the bobbins 21.1, 21.2 and 21.3 are wound. The winding spindles 19.1 and 19.2 are arranged on a winding turret 20 as a cantilever, which pivots the winding spindles alternately between an operating region and an exchange region to allow continuous winding.

The feeding of the sheet of strands 29 to the winding apparatus 17 occurs over a guide roller 16, which is arranged downstream of the drawing device 13.

In the example embodiment shown in FIGS. 1 and 2, the threads 5.1 to 5.3 extruded by the spinnerets 4.1 to 4.3 are pulled off, in each case individually and separately, by the driven individual godets 11.1 to 11.3. In this process, the same pull-off speed can be set on each of the threads 5.1 to 5.2 so that each of the threads of 5.1 to 5.3 can be extruded, then cooled and pulled off under the same conditions. Only then are the threads 5.1 to 5.3 combined together into a sheet of strands 29 in order to be collectively drawn in the drawing device 13 and subsequently wound together by the winding apparatus 17 to bobbins. In addition to the constant pull-off conditions, the multiple wrap on the godets, any larger deflections and spreading of the sheet of strands are avoided. To this extent, greater number of threads can thus be advantageously produced with a collective treatment with essentially the same physical characteristics.

Figure 3:
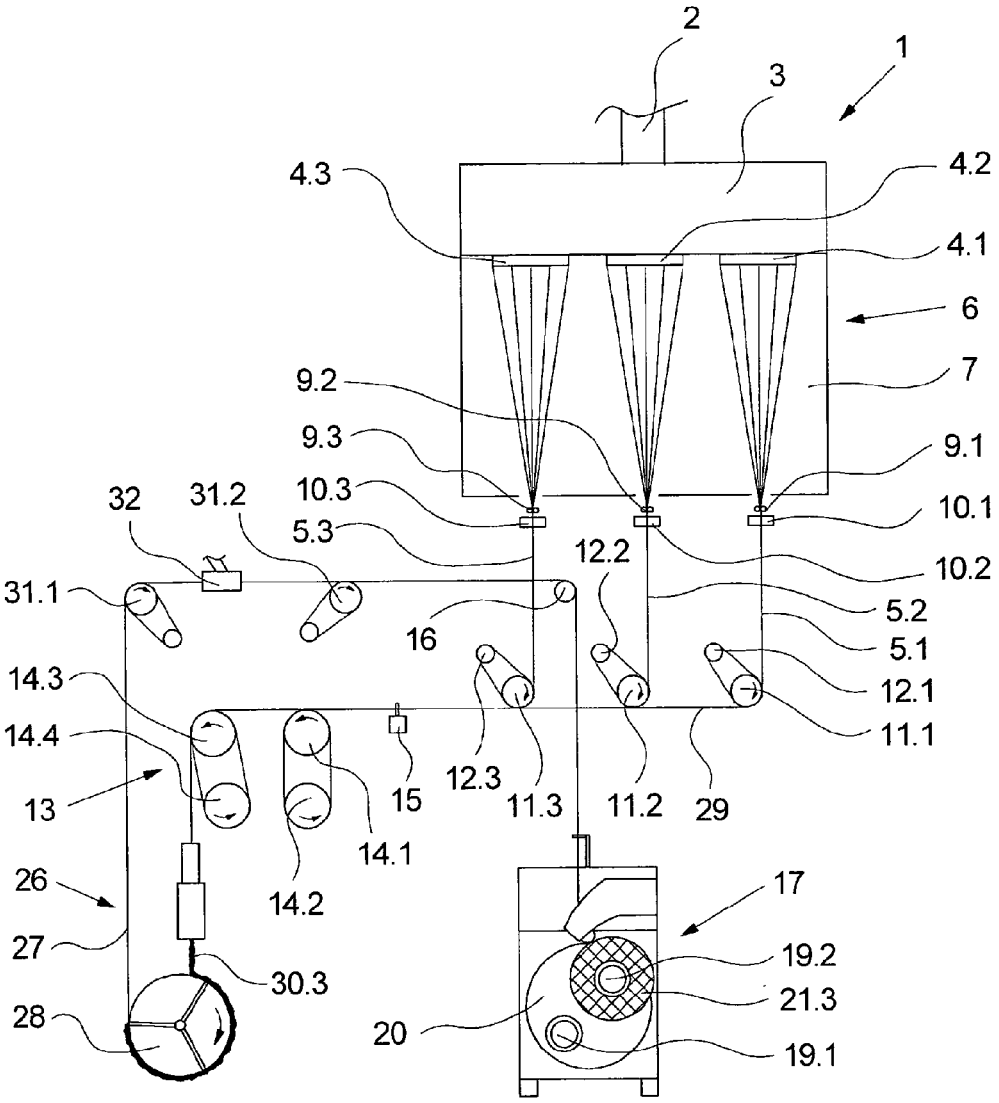
FIG. 3 schematically shows a plan view of another embodiment the inventive apparatus.
Figure 4:
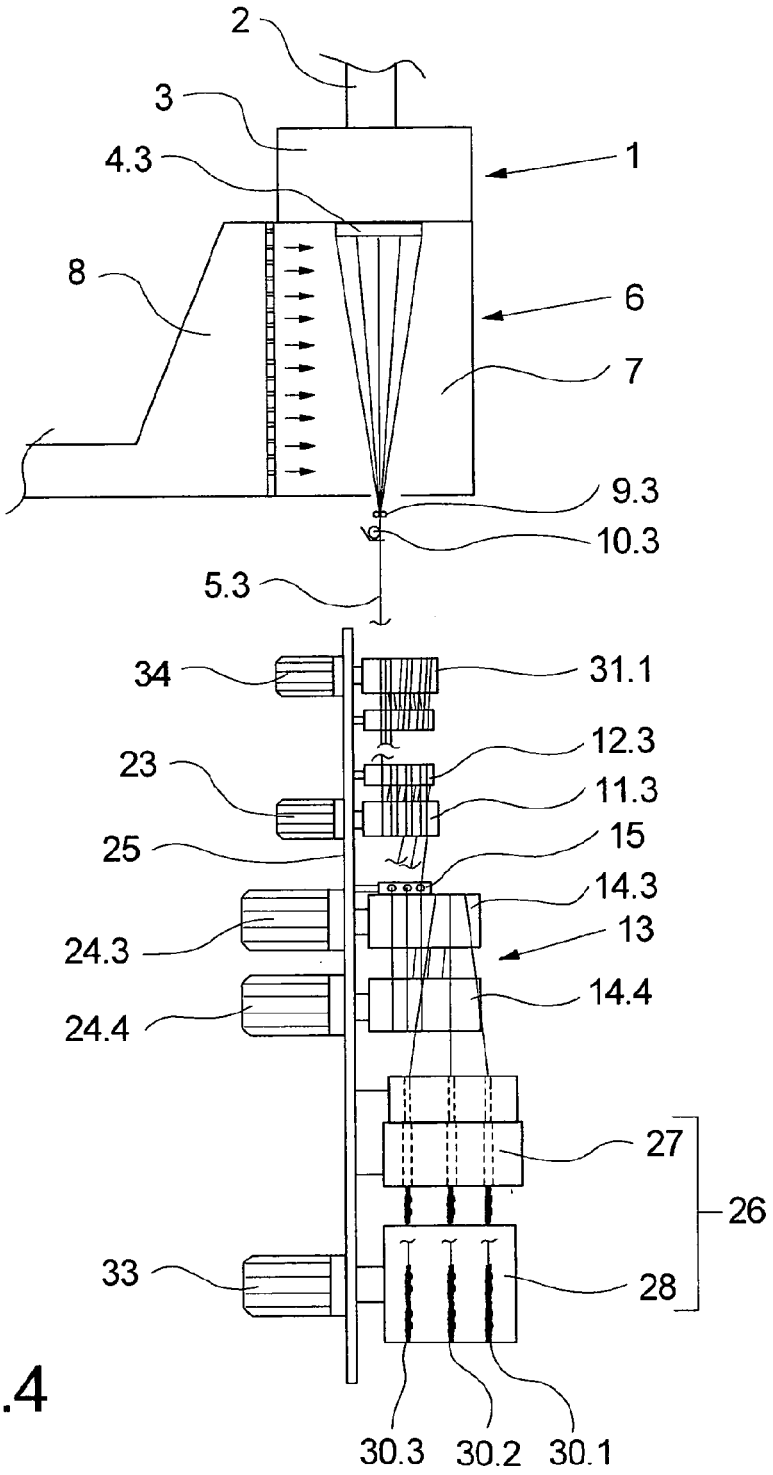
FIG. 4 is a schematic side view of the embodiment of FIG. 3.

In this respect, the inventive method and the inventive apparatus are particularly advantageous for producing high-quality threads in a melt spinning process, which can be directly used in subsequent processing. Thus, FIGS. 3 and 4 show another preferred embodiment of the invention, in which, after the drawing of the threads, a crimp is generated at the threads. The exemplary embodiment shown in FIGS. 3 and 4 is essentially identical to the aforementioned embodiment so that at this point, only the differences will be explained, and otherwise reference is made to the above description.

In the example embodiment shown in FIGS. 3 and 4, a crimping device 26 is arranged between the drawing device 13 and the winding device 17. The crimping device 26 comprises a plurality of texturing means 27 to texture the drawn threads 5.1 to 5.3 in parallel side by side as a sheet of strands. The texturing means 27 can be, for example, texturing nozzles that consist of a delivery nozzle and a stuffer box. Thereby each of the threads 5.1 to 5.3 is reshaped to a thread plug 30.1 to 30.3. Such crimping devices are well known so that at this point no further explanation is needed. The crimping device 26 comprises a cooling roller 28, on whose periphery are provided three thread guide tracks for receiving the thread 30.1 to 30.3. At the periphery of the cooling roller 28, the thread plugs 30.1 to 30.3 are cooled. The cooling roller 28 is driven by a roller drive 33.

As is further apparent from the illustration in FIG. 3, after crimping, the thread plugs 30.1 to 30.2 are dissolved into the threads 5.1 to 5.3 and collectively pulled by a pull-off godet 31.1 off the cooling roller 28. Downstream the pull-off godet 31.1, a further godet 31.2 is arranged and is combined with an overtravel roll. A swirling device 32 is located between the pull-off godets 31.1 and 31.2. The pull-off godets 31.1 and 31.2 are independently driven, and FIG. 4 shows only the drive 34 of the godet 31.1. To treat the sheet of strands 29, the swirling device 32 comprises three separate processing channels, in which each of the threads 5.1, 5.2, and 5.3 is individually swirled. So, in addition to crimping, an intensive thread end on the threads 5.1 to 5.3 is produced, which is subsequently fed to over the pulley 16 into the winding device 17. In the winding device 17, the crimped threads 5.1 to 5.3 are wound parallel side by side to bobbins, as has already been shown in FIG. 2.

The method and apparatus of the invention are thus particularly advantageous to allow an individual pull-off of the threads with a subsequent collective treatment and a shared use of the subsequent devices. FIGS. 1 to 4 only show a few exemplary embodiments of the invention. Basically, the threads pulled off the individual godets can also be formed from a plurality of filament bundles. It is essential here that the thread led and treated in the sheet of strands is first individually pulled off during the extrusion and the cooling.

REFERENCE LIST

1 Spinning device
2 Inlet
3 Spinning beam
4.1, 4.2, 4.3 Spinneret
5.1, 5.2, 5.3 Thread
6 Cooling device
7 Cooling shaft
8 Puffer
9.1, 9.2, 9.3 Collecting thread guide
10.1, 10.2, 10.3 Preparation device
11.1, 11.2, 11.3 Individual godet
15 12.1, 12.2, 12.3 Overtravel roller
13 Drawing device
14.1, 14.2, 14.3, 14.4 Drawing godet
15 Multiple thread guides
16 Deflection pulley
17 Winding device
18.1 18.2 18.3 Winding positions
19.1, 19.2 Spindles
20 Spindle turret
21.1, 21.2, 21.3 Bobbins
23 Drive of the individual godets
24.1, 24.2 Drive of the drawing godets
25 Machine frame
26 Crimping device
27 Texturing means
28 Cooling roller
29 Sheet of strands
30 Thread plug
31.1, 31.2 Pull-off godet
32 Swirling device
33 Roller drive
34 Drive of the pull-off godet

The invention claimed is:

1. An apparatus for melt-spinning, drawing, and winding multiple synthetic threads comprising:

a spinning device, which has a plurality of spinnerets for extruding a plurality of filaments strands per thread;

a drawing device downstream of the spinning device which comprises a number of drawing godets are arranged one after another for the collective drawing of the threads;

several juxtaposed individual godets arranged upstream of the drawing device, the individual godets being respectively associated with each one of the threads and being individually drivable to pull off a respective thread; and a winding device downstream of the drawing device, which comprises a plurality of winding positions for the collective winding of the threads to a plurality of bobbins, wherein each individual godet is associated with a separate drive configured to independently drive each individual godet.

2. The apparatus of claim 1, wherein each individual godet is spaced from and centered with respect to a respective associated spinneret.

3. The apparatus of claim 1, further comprising a rotatably mounted overtravel roller associated with a respective individual godet.

4. The apparatus of claim 3, wherein the individual godets include a heated godet shell.

5. The apparatus of claim 1, wherein the drawing device includes a first drawing godet arranged downstream from the individual godets, and the first drawing godet is associated on its inlet side with a multiple thread guide.

6. The apparatus of claim 1, further comprising a crimping device between the drawing device and the winding device, wherein the crimping device includes comprises several texturing means for collective crimping of the threads.

* * * * *